US005549221A

United States Patent [19]

Conlee

[11] Patent Number: 5,549,221

[45] Date of Patent: Aug. 27, 1996

[54] FLEXIBLE TUBE END-LAP RETAINER

[76] Inventor: Ralph B. Conlee, 11716 N. Williamsburg Dr., Knoxville, Tenn. 37922-3318

[21] Appl. No.: 299,343

[22] Filed: Sep. 1, 1994

[51] Int. Cl.[6] ..... B65D 35/28

[52] U.S. Cl. ..... 222/103; 24/563; 202/95

[58] Field of Search ..... 222/95, 101, 103; 24/67.7, 545, 563

[56] References Cited

U.S. PATENT DOCUMENTS

| | | | |
|---|---|---|---|
| 2,061,840 | 11/1936 | Lake | 24/545 X |
| 2,166,344 | 7/1939 | Donohue | 24/563 X |
| 2,390,314 | 2/1945 | Massey | 222/103 |
| 2,789,782 | 4/1957 | Huth | 24/563 X |
| 3,463,359 | 8/1969 | Piggush | 222/103 |
| 3,536,234 | 10/1970 | Rise | 222/103 |
| 4,266,006 | 10/1980 | Toyama | 24/545 X |
| 4,365,727 | 12/1982 | Shmelkin | 222/97 |
| 4,405,062 | 9/1983 | Tschida, Sr. | 222/102 |
| 4,576,314 | 3/1986 | Elias et al. | 222/97 |
| 4,729,496 | 3/1988 | Davidson | 222/215 |
| 4,817,823 | 4/1989 | Sparr | 222/103 |
| 4,976,380 | 12/1990 | Von Schuckmann | 222/103 |
| 5,145,093 | 9/1992 | Zeller | 222/103 |
| 5,201,799 | 4/1993 | Johnson | 24/563 X |

FOREIGN PATENT DOCUMENTS

| | | | |
|---|---|---|---|
| 0478988 | 4/1992 | European Pat. Off. | 222/103 |
| 676278 | 11/1929 | France | 24/67.9 |
| 1159246 | 9/1956 | France | 222/103 |
| 525575 | 5/1955 | Italy | 222/103 |
| 116815 | 7/1946 | Sweden | 24/67.9 |

*Primary Examiner*—Joseph A. Kaufman

[57] ABSTRACT

The present end-lap retainer is a one-piece device having a particular configuration so as to fit snugly over the end of a pliable tube used to dispense viscous materials, such as, toothpaste, glue, ointment, etc. During the normal use process, a toothpaste user will lap or fold the bottom end of the tube when the tube becomes partially depleted. This lapping process forces the remaining paste upward toward the top of the tube for easy dispensing of its contents. The end-lap retainer device is attached to the laps or folds, holding them firmly in place, thereby preventing any unlapping or back flow of the contents when pressure is applied to the tube during dispensing.

8 Claims, 1 Drawing Sheet

FIG. 1a
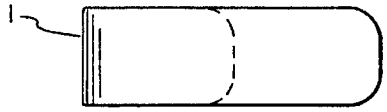
FIG. 1b
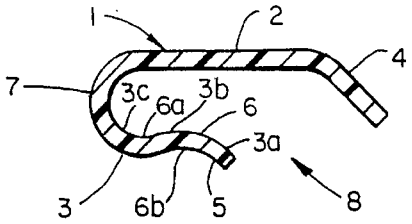
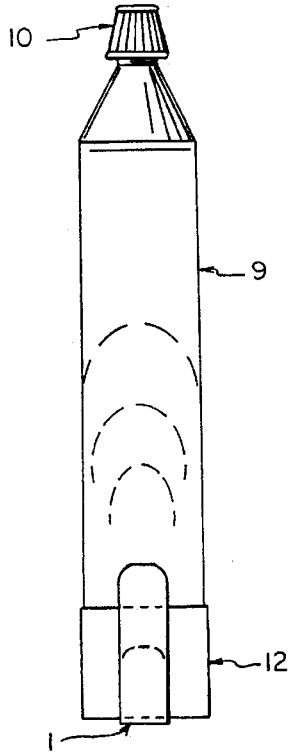
FIG. 2
FIG. 3
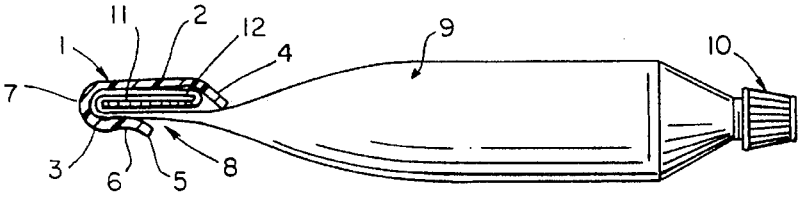
FIG. 4
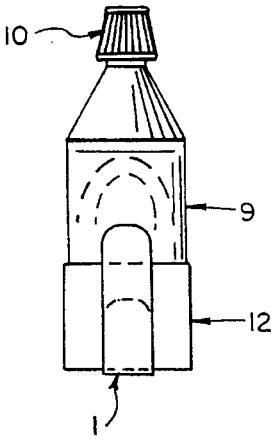
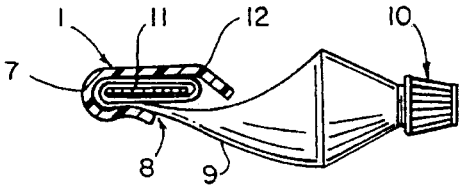
FIG. 5

FLEXIBLE TUBE END-LAP RETAINER

FIELD OF THE INVENTION

The present invention relates to a device for dispensing various viscous materials, e.g. toothpaste, glue, etc., from a collapsible tube container, and in particular, a device which prevents the viscous material within the non-flattened portion of the tube from re-entering into the emptied flattened end portion of the tube as the non-flattened end portion is squeezed to further dispense the viscous material from the flexible tube.

BACKGROUND OF THE INVENTION

It is general practice for individual users to squeeze a collapsible tube and roll or lap the collapsible tube container from the bottom up in order to extrude, as much as possible, the fluent material from the tube. The collapsible tube can either be made of plastic or of a foil metal material in which when a slight even manual pressure is applied to the tube will dispense a uniform flow of the material out through the tube outlet. However, this becomes a very clumsy and messy task. The fluent material inside the tube inevitably passes back into the flat end portion of the tube as one squeezes the tube and thus requires the user to repeatedly roll-up the tube before each use. As a result much of the fluent material is wasted because it is lost or is thrown away all together in the tube.

The prior art shows various structures that have been devised for use of expelling the contents of a collapsible tube in a more suitable manner. Examples of these structures are disclosed in U.S. Pat. Nos. 2,390,314, 4,817,823, 4,976,380 and 5,145,093. The U.S. Pat. No. 3,463,359 to Piggush and U.S. Pat. No. 4,576,314 Elias et al. both show a tube support and device for squeezing and winding a collapsible tube around a particular elongated key member. The patents to Rise U.S. Pat. No. 3,536,234, Shmelkin U.S. Pat. No. 4,365,727 and Tschida, Sr. U.S. Pat. No. 4,405,062 show particular tube dispensing devices which include a pair of closable jaws or hinged frames adapted to be received at the bottom of a collapsible tube container. Additionally, the patent to Davidson U.S. Pat. No. 4,729,496 discloses an applicator clamp for a flexible dispensing tube including a unit body having an elongated pressure plate and an elongated open-ended retainer tube. A rigid lock pin having a length greater than the width of the pressure plate projects along the length of the retainer tube and within reverse-turned flattened portion of the tube.

All of the above described prior art structures include complicated designs having large multiple parts which presents the difficult problem of disassembling the device when trying to remove, roll-up and/or replace the spent collapsible tube. It is also easy to lose and it requires special care on the part of the user not to break the device, particularly since it is used possibly several times a day. Further, the above devices lack a design that effectively attaches to the lapped end of a collapsible tube and efficiently engages the tube so as to expel all of the recoverable valuable viscous material inside the collapsible tube container.

SUMMARY OF THE INVENTION

The present invention is directed to an end-lap retainer for a collapsible tube which overcomes the drawbacks and deficiencies of the prior art discussed above. The retainer is a unitary one-piece device which, because of its particular designed configuration, attaches snugly over the end of a pliable tube used to dispense viscous materials, such as toothpaste, glue, ointment, etc.

An object of the present invention is to construct a retainer or clip device which is designed to hold successive bottom end-laps in place during the depletion, through gradual use, of the contents of a collapsible tube container.

Another object of the invention is to construct a retainer device which is small and simple in design.

A further object of the present invention is to provide an end-lap retainer which is universally accepted and is inexpensive to manufacture.

Another object of the present invention is to provide a durable retainer device which is easy to operate with a minimum of care and effort on the part of the user.

Another object of the present invention is to provide a resilient retainer which tightly clamps the lapped portion of a collapsible tube to prevent the material from reentering the lapped portion of the tube while applying manual pressure during extrusion of the paste.

A further object of the present invention is to provide a retainer device which is simple, practical and convenient to use for efficiently removing most, if not all, of the recoverable viscous material from the collapsible tube container.

Yet another object of the present invention is provide a durable end-lap retainer device which can be made from plastic or metal, but preferably from a recycled material, which is suitable for multiple uses with a plurality of tube containers.

These and other objects and features, will be seen from the following specification and claims in conjunction with the appended drawings.

BRIEF DESCRIPTION OF THE DRAWINGS

FIG. 1*a* is a top view of the present end-lap retainer invention.

FIG. 1*b* is a side view of the present end-lap retainer invention.

FIG. 2 is a front view of a partially emptied collapsible tube having the present end-lap retainer mounted over its lapped sealed bottom end.

FIG. 3 is a side view, similar to FIG. 2, illustrating the manner in which the present end-lap retainer is attached over the lapped sealed bottom end of the collapsible tube.

FIG. 4 is a front view of a further emptied and lapped collapsible tube engaged by the subject end-lap retainer.

FIG. 5 is a side view, similar to FIG. 4, illustrating the lapped bottom end portion of the collapsible tube further folded and engaged by the present end-lap retainer.

DETAILED DESCRIPTION OF THE PREFERRED EMBODIMENT

Referring to the drawings, FIGS. 1–5, the present end-lap retainer 1 is adapted for use in conjunction with a collapsible tube 9 having a dispenser outlet top 10. The collapsible tube 9 can contain many different viscous or liquid materials or the like including, toothpaste, glue, gel, ointments, etc. The material is easily dispensed from the tube 9 as the user applies a slight manual pressure to the tube progressively forcing the contents out the top outlet 10. As the contents of the tube are gradually depleted the sealed bottom end of the tube 9 is folded or lapped 12, as shown in FIGS. 2–5.

The collapsible tube 9 is a standard tube structure which is well known commercially and can be made from any type of well known plastic or foil metal material.

The end-lap retainer of the present invention is referred to in general by the reference numeral 1, as shown in FIG. 1*b*. The end-lap retainer 1 is generally J-shaped in cross-section having a long top side 2, an elbow or circular arc 7 and a short lower side 3. The long top side 2 and the short lower side 3 along with the circular arc 7 form a singular one-piece unit having an opening at 8. The long top side 2, preferably twice the size in length as the short lower side 3, includes an arced unconnected end 4 which is bent slightly toward the center, approximately 45 degrees, of opening 8. The retainer terminates in the short lower end 3 comprising an unconnected end 5 having a curved midpoint 6. As further illustrated in FIG. 1*b*, the short lower end has a sine wave configuration consisting of a from portion 3*a*, a middle portion 3*b* and a rear portion 3*c*. The short lower end defines a first arcuate surface 6*a* on top of the rear portion and defines a second arcuate surface 6*b* on the middle portion to retain a depleted portion of the container. The end-lap retainer 1 can be made from a variety of plastic or metal materials, but preferably it is made from a recycled material.

FIG. 1*a* shows a top view of the end-lap retainer which preferably is small in size, varying in length and width, so as to be easily handled by the user and adaptable to any type of tube container.

As shown in FIG. 2 the end of the tube 9 is lapped or folded 12 up towards the top of the tube and held in position by the present end-lap retainer 1.

FIG. 3, shows a side view of the end-lap retainer 1 in which the long top side 2 is substantially parallel to the short lower side 3 and defines with the top side 2 the opening 8 through which extends the end lapped portion 12 of the collapsible tube 9. The end lapped portion 12 of the collapsible tube 9 is reversed turned or folded over which is adapted to fit against adjacent traverse portion of the elongated top side 2. The lapped end portion 12 is held tightly in place due to the arced unconnected end 4 which bends slightly inward at 45 degrees toward the opening 8 to prevent any backward movement or uncoiling when pressure is applied while dispensing the contents of the tube 9. The lapped end portion 12 of the collapsible tube 9 define the portions from which the material has been completely squeezed or expelled from the tube toward and out the collapsible tube outlet 10.

FIGS. 4 and 5 show a further front and side view accordingly of the end-lap retainer 1 attached at the lapped portion 12 as the tube 9 is progressively emptied of its contents.

In operation, the end-lap retainer i is durable and resilient in design so as to make it easy to attach and remove it to and from the lapped end 12 of the collapsible tube 9, no matter how many folds have been set. In order to attach the retainer 1 it requires the user to position the opening 8 of the retainer 1 along the bottom edge of the tube 9 and with a slight twist in a counter-clockwise direction push to completely attach having full contact on the tube 9. Removing the retainer 1 requires the user to rest his/her thumb on the long top side 2 and his/her index finger on the short bottom side 3 right at the midpoint 6. A slight twist in a clockwise direction removes the retainer 1 easily from the end or lapped portion 12. The key feature of the subject invention is the curved midpoint 6 on the raised section of the short bottom side 3 which acts as a pivotal point during the attachment and removal process.

The present end-lap retainer 1 has proved to be a practical and an ideal device as an aid in the dispensing of viscous materials from pliable tube containers. Not only does it provide the convenience of retaining the lapped portions of the tube but it is likely to result in the saving of toothpaste for the consumer. It further provides the user of an indication of the amount of material that has been used or is remaining in the tube so the consumer then knows when it is time to replace the tube. Also, the retainer provides a tight seal which prevents the outside air from entering the tube and drying or hardening its contents.

While having shown and described an embodiment of this invention in some detail, it will be understood that this description and illustrations are offered merely by way of example, and that the invention is to be limited in scope only by the appended claims.

I claim:

1. A J-shaped retainer device for use in manually dispensing material from a tubular container and for clipping a depleted portion thereof, consisting of:

a top side member, said top side member having an unconnected arced end which is bent slightly, a bottom side member, having a sine wave configuration, said bottom side member further including a front portion, a middle portion and a rear portion, said bottom side member spaced from said top member to form an air space said bottom member defining a first arcuate surface on top of said rear portion and defining a second arcuate surface on said middle portion to retain a depleted portion of said container, said bottom side member having an unconnected end, said top side member extending into said bottom side member connected by a circular arc portion to form a unitary formed body; and said top side member generally parallel to and twice the size in length as said bottom side member.

2. A retainer device as claimed in claim 1, wherein said retainer is made of plastic.

3. A retainer device as claims in claim 1, wherein said retainer is made of a metal material.

4. A retainer device as claimed in claim 1, wherein said retainer is made of a recycled compound material.

5. A plastic J-shaped retainer device for use in manually dispensing material from a tubular container and for clipping the depleted portions thereof, consisting of:

an elongated top side member, said top side member including an unconnected end portion having a curved arc extension which is bent slightly toward the center, a lower side member, said lower side member having a sine wave configuration, said lower side member further including a front portion, a middle portion and a rear portion, said lower side member spaced from said top side member to form an air space, said lower side member defining a first arcuate surface on top of said rear portion and defining a second arcuate surface on said middle portion to retain a depleted portion of said container.

said elongated top side member generally parallel and connected to said lower side member by a circular arc portion to form a unitary body; and said top side member extending into and terminating at said lower side member to define an opening between said top side member and said lower side member, said curved arc extension bending slightly inward at 45 degrees toward the opening to prevent any backward movement or uncoiling when pressure is applied to said tube.

6. A retainer device as claimed in claim 5, wherein said top side member is substantially one inch in length.

7. A retainer device as claimed in claim 5, wherein said lower side member is substantially one half inch in length.

8. A retainer device as claimed in claim 5, wherein said retainer device is flexible and substantially one half inch in width.

* * * * *